US009692162B2

(12) United States Patent
Sunaga et al.

(10) Patent No.: US 9,692,162 B2
(45) Date of Patent: Jun. 27, 2017

(54) ELECTRIC CONTACT AND CONNECTOR TERMINAL PAIR

(71) Applicants: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD., Osaka-shi, Osaka (JP)

(72) Inventors: Takahiro Sunaga, Yokkaichi (JP); Yoshifumi Saka, Yokkaichi (JP); Yasushi Saitoh, Yokkaichi (JP); Akihiro Kato, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 15/036,883

(22) PCT Filed: Nov. 19, 2014

(86) PCT No.: PCT/JP2014/080630
§ 371 (c)(1),
(2) Date: May 16, 2016

(87) PCT Pub. No.: WO2015/083547
PCT Pub. Date: Jun. 11, 2015

(65) Prior Publication Data

US 2016/0276768 A1 Sep. 22, 2016

(30) Foreign Application Priority Data

Dec. 4, 2013 (JP) ..... 2013-251254

(51) Int. Cl.
*H01R 13/02* (2006.01)
*H01R 13/03* (2006.01)
(Continued)

(52) U.S. Cl.
CPC ..... *H01R 13/03* (2013.01); *C25D 5/10* (2013.01); *C25D 5/505* (2013.01); *C25D 7/00* (2013.01); *H01R 13/111* (2013.01); *H01R 13/11* (2013.01)

(58) Field of Classification Search
CPC ..... H01R 13/03; H01R 13/02; H01R 4/58; H01R 43/12; H01R 43/16
(Continued)

(56) References Cited

U.S. PATENT DOCUMENTS 3,435,168 A * 3/1969 Cooney ..... G06K 7/042 174/75 R
4,342,498 A * 8/1982 Patton ..... H01R 13/187 439/839
(Continued)

FOREIGN PATENT DOCUMENTS

JP 2007-254876 A 10/2007
JP 2008-270192 A 11/2008
(Continued)

OTHER PUBLICATIONS

Feb. 3, 2015 Search Report issued in International Patent Application No. PCT/JP2014/080630.

*Primary Examiner* — Abdullah Riyami
*Assistant Examiner* — Vladimir Imas
(74) *Attorney, Agent, or Firm* — Oliff PLC

(57) ABSTRACT

An electric contact includes a bulge-shaped contact having a bulge shape, and a plate-shaped contact that has a plate shape and comes into electrical contact with an apex portion of the bulge-shaped contact. The bulge-shaped contact has a
(Continued)

silver-tin alloy layer and a silver coating layer that coats the surface of the silver-tin alloy layer and is exposed at an outermost surface. The plate-shaped contact has a silver layer that does not have a silver-tin alloy layer directly below and is exposed at the outermost surface. Also, a connector terminal pair has such an electric contact in a contacting portion.

11 Claims, 10 Drawing Sheets

(51) Int. Cl.
*C25D 7/00* (2006.01)
*C25D 5/10* (2006.01)
*C25D 5/50* (2006.01)
*H01R 13/11* (2006.01)

(58) Field of Classification Search
USPC ..... 439/887, 886, 647
See application file for complete search history.

(56) References Cited

U.S. PATENT DOCUMENTS 6,755,958 B2 * 6/2004 Datta ..... C23C 28/021 205/176
7,651,785 B2 * 1/2010 Takei ..... C23C 30/00 205/109
8,016,624 B2 * 9/2011 Oda ..... C25D 5/12 428/646
8,342,895 B2 * 1/2013 Yoshida ..... C25D 5/10 439/886
8,728,629 B2 * 5/2014 Kitagawa ..... C25D 5/10 148/525
9,114,594 B2 * 8/2015 Zhang-Beglinger .. B32B 15/018
RE45,924 E * 3/2016 Oda ..... C25D 5/12
9,401,556 B2 * 7/2016 Tsugawa ..... H01R 13/26
2003/0091855 A1 * 5/2003 Tanaka ..... B32B 15/01 428/647
2003/0186597 A1 * 10/2003 Suzuki ..... H01R 13/03 439/886
2005/0176267 A1 * 8/2005 Saitoh ..... H01R 12/585 439/49
2006/0260678 A1 * 11/2006 Nagao ..... H01H 1/023 136/256
2010/0186993 A1 * 7/2010 Yamaguchi ..... H01H 1/021 174/126.2
2011/0162707 A1 * 7/2011 Schuisky ..... C23C 14/08 136/256
2015/0079422 A1 * 3/2015 Sunaga ..... C23C 28/023 428/673

FOREIGN PATENT DOCUMENTS

JP 2013-147696 A 8/2013
JP 2013-231228 A 11/2013

* cited by examiner

WORK EX. 1
EMBOSSED: Ag/AgSn
FLAT PLATE: Ag

ELECTRIC CONTACT AND CONNECTOR TERMINAL PAIR

TECHNICAL FIELD

The present disclosure relates to an electric contact and a connector terminal pair, and more specifically relates to an electric contact in which a silver layer is exposed at an outermost surface and a connector terminal pair having such an electric contact.

BACKGROUND ART

High-output motors are used in hybrid cars, electric cars, and the like. A large electric current flows through the connector terminals of high-output motors or the like having a large conduction current, and thus the heat emission increases. The size of the connector terminals also increases in accordance with the current capacity, and therefore an insertion force required to insert them increases and the damage to the surface of the terminals at the time of insertion also increases. As the number of instances of the insertion and removal for maintenance of this type of connector terminals for large currents increases, there is the need for a connector terminal having heat resistance and abrasion resistance.

Conventionally, in general, a connector terminal obtained by plating a surface of a base material such as copper or a copper alloy with tin or the like has been used as a connector terminal that connects electric parts of a car or the like. However, in the case where the conventional tin plated terminal is used with such a large electric current, the conventional tin plated terminal does not have sufficient heat resistance. In view of this, there are cases where a silver plated terminal is used instead of the tin plated terminal as a connector terminal in which a large electric current is used. Silver has a low electric resistance value, keeps a temperature increase at the time of conduction low, has a high melting point, and achieves high heat resistance. Also, silver plating achieves very high corrosion resistance.

However, silver has properties of crystal particles easily coarsening due to recrystallization, and if a terminal obtained by performing silver plating is used in a high temperature environment, its hardness decreases due to the growth of crystal particles. Accordingly, problems such as an increase in the force required for inserting the terminal and an increase in its frictional coefficient arise.

In view of this, as shown in Patent Document 1, the inventor of the invention described in the present disclosure achieved a decrease in frictional coefficient of an electric contact by forming a layer structure in which the surface of a hard silver-tin alloy layer is coated with a soft silver coating layer in an electric contact of a connector terminal. The frictional coefficient can be reduced and softening is unlikely to occur even at a high temperature due to the hardness of the silver-tin alloy layer. Moreover, due to the fact that this silver-tin alloy layer is not exposed at the outermost surface and is coated with a silver coating layer that is relatively unlikely to oxidize, compared to the case where the silver-tin alloy layer is exposed at the outermost surface, an increase in the contact resistance resulting from the formation of tin oxides at high temperature can also be suppressed.

CITATION LIST

Patent Documents

Patent Document 1: JP 2013-231228A

As described above, if a layer structure in which the silver coating layer is formed on the surface of the silver-tin alloy layer is formed at an electric contact of a connector terminal, a low frictional coefficient can be obtained, and compared to a case where the silver-tin alloy layer is exposed at the outermost surface or the like, for example, low contact resistance can be obtained. However, silver is softer than other metals, has a property of undergoing cohesion, and is likely to be removed by friction or the like. Even if the silver-tin alloy layer is coated with the silver coating layer in an initial state, if the silver-tin alloy layer is exposed due to partial removal of the silver coating layer resulting from abrasion sufficiently low contact resistance is not necessarily obtained. That is, a layer structure in which the surface of a silver-tin alloy layer is coated with a silver coating layer, as shown in Patent Document 1, has superior abrasion resistance in the sense of having a low frictional coefficient, but does not necessarily have superior abrasion resistance in the sense of its contact resistance being unlikely to increase when undergoing abrasion. Connector terminals need to maintain low contact resistance even after a plurality of number of instances of insertion and removal.

An issue that the present disclosure is to resolve is to provide an electric contact that has superior abrasion resistance in the sense of having a low frictional coefficient and maintaining low contact resistance when subject to abrasion, and a pair of connector terminals having such an electric contact.

In order to resolve the above-described issue, an electric contact according to the present disclosure includes a bulge-shaped contact having a bulge shape, and a plate-shaped contact that has a plate shape and comes into electrical contact with an apex portion of the bulge-shaped contact, in which the bulge-shaped contact has a silver-tin alloy layer and a silver coating layer that coats a surface of the silver-tin alloy layer and is exposed at an outermost surface, and the plate-shaped contact has a silver layer that does not have a silver-tin alloy layer directly below and is exposed at the outermost surface.

Here, it is preferable that the silver coating layer formed at the bulge-shaped contact is thinner than the silver-tin alloy layer.

Also, it is preferable that the silver layer formed at the plate-shaped contact is thicker than the silver coating layer formed at the bulge-shaped contact.

Also, it is preferable that at the bulge-shaped contact, a primer metal layer that coats a surface of a base material and contains nickel or copper as a main component is formed, and the silver-tin alloy layer is formed in contact with the primer metal layer.

The primer metal layer may be made of nickel or a nickel alloy, and a portion of the nickel may form an alloy with tin included in the silver-tin alloy layer.

Also, at the bulge-shaped contact, a thickness of the silver-tin alloy layer may be in a range of 1 to 45 μm and a thickness of the silver coating layer may be in a range of 0.5 to 15 μm.

It is preferable that a contact resistance between the bulge-shaped contact and the plate-shaped contact is not more than 0.4 mΩ, the contact resistance being measured after the bulge-shaped contact and the plate-shaped contact have been slid relative to each other.

It is preferable that a change in a contact resistance between the bulge-shaped contact and the plate-shaped contact is not more than 0.2 mΩ when the bulge-shaped contact and the plate-shaped contact are slid relative to each other.

It is preferable that an average value of frictional coefficients between the bulge-shaped contact and the plate-shaped contact is not more than 0.6, the frictional coefficients being measured while the bulge-shaped contact and the plate-shaped contact are slid relative to each other for 200 round trips over a 7 mm distance.

In a case where at the bulge-shaped contact, a primer metal layer that coats the surface of the base material and is made of nickel or a nickel alloy is formed and the silver-tin alloy layer is formed in contact with the primer metal layer, it is preferable that the base material of the bulge-shaped contact is not exposed after the bulge-shaped contact and the plate-shaped contact have been slid relative to each other.

Also, it is preferable that after the bulge-shaped contact and the plate-shaped contact have been slid relative to each other, metal of a layer below the silver layer is not exposed at the plate-shaped contact.

A connector terminal pair according to the present disclosure includes a pair of connector terminals that come into electrical contact with each other at a contacting portion, and the contacting portion has electric contacts such as that described above.

Advantageous Effects

At the electric contact according to the present disclosure, a layer structure of a silver-tin alloy layer and a silver coating layer is formed on a surface of the bulge-shaped contact, and a silver layer is formed on a surface of the plate-shaped contact. With such a configuration, this electric contact has a low frictional coefficient. At the same time, compared to a case where the layer structures of the silver-tin alloy layer and the silver coating layer are formed on the surfaces of the bulge-shaped contact and the plate-shaped contact, a contact resistance when subject to abrasion is kept low. In this manner, since the electric contact has a predetermined metal layer structure on the surfaces of the bulge-shaped contact and the plate-shaped contact, the electric contact is an electric contact that has superior abrasion resistance in the sense of having a low frictional coefficient and the contact resistance being kept low even with undergoing abrasion.

Here, if the silver coating layer formed at the bulge-shaped contact is thinner than the silver-tin alloy layer, the electric contact has a great effect of reducing the frictional coefficient.

Also, if the silver layer formed at the plate-shaped contact is thicker than the silver coating layer formed at the bulge-shaped contact, after the electric contact undergoes friction, the effect of keeping the contact resistance low is likely to be greatly exhibited.

Also, at the bulge-shaped contact, if the primer metal layer that coats the surface of the base material and contains nickel or copper as a main component is formed and the silver-tin alloy layer is formed in contact with the primer metal layer, as a result of metal that constitutes the base material of the bulge-shaped contact diffusing in the silver-tin alloy layer and the silver coating layer and being oxidized, the effect of avoiding an increase in the contact resistance and the effect of increasing adherence of the base material and the silver-tin alloy layer can be obtained. If the primer metal layer is made of nickel or a nickel alloy, a portion of the nickel is likely to form an alloy with tin that constitutes the silver-tin alloy layer.

Also, at the bulge-shaped contact, if the thickness of the silver-tin alloy layer is in a range of 1 to 45 μm, and the thickness of the silver coating layer is in a range of 0.5 to 15 μm, a decrease in the frictional coefficient and the suppression of the contact resistance when subject to abrasion are likely to be highly achieved.

If the contact resistance between the bulge-shaped contact and the plate-shaped contact, the contact resistance being measured by sliding the bulge-shaped contact and the plate-shaped contact relative to each other, a change in the contact resistance, and the frictional coefficient are suppressed to the above-described respective values, even if undergoing sliding between both contacts, the electric contact has a low frictional coefficient and low contact resistance, and a state in which superior abrasion resistance is achieved can be maintained.

Moreover, after the bulge-shaped contact and the plate-shaped contact have been slid relative to each other, suppressing exposure of metal of the lower layer at the surfaces of the bulge-shaped contact and the plate-shaped contact achieves both a low frictional coefficient and low contact resistance and improves the effect of maintaining the state in which superior abrasion resistance is achieved.

The connector terminal pair present disclosure includes electric contacts in which a layer structure of the silver-tin alloy layer and the silver coating layer is formed on the surface of the bulge-shaped contact and the silver layer is formed on the surface of the plate-shaped contact. Accordingly, a low frictional coefficient is exhibited at the contacting portion, and even if the connector terminal pair undergoes abrasion, a low contact resistance is exhibited, and thus abrasion resistance is obtained in terms of two aspects.

BRIEF DESCRIPTION OF DRAWINGS

FIG. 1A illustrates an alloy-containing layer structure, and FIG. 1B illustrates a silver single-layer structure.

FIGS. 3A and 3B illustrate different layer structures.

DETAILED DESCRIPTION OF EMBODIMENTS

Hereinafter, an embodiment of the present disclosure will be described in detail with reference to the drawings.

Electric Contact

Figure 1A:
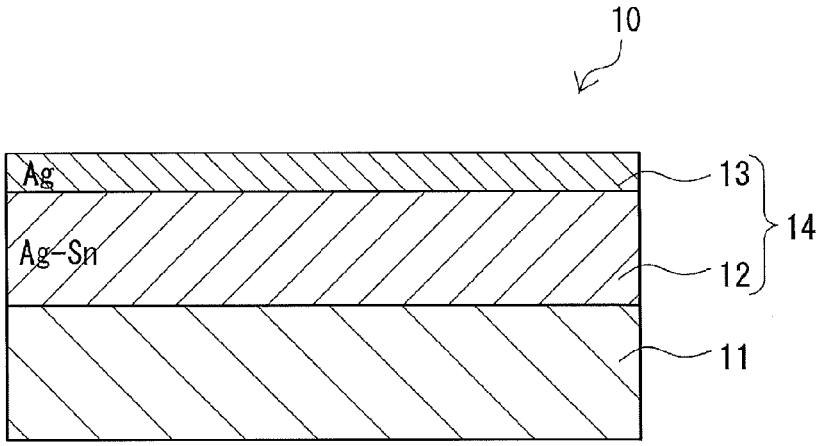
FIGS. 1A and 1B are cross-sectional views schematically showing two types of metal layer structures that constitute an electric contact according to an embodiment of the present disclosure, where
Figure 1B:
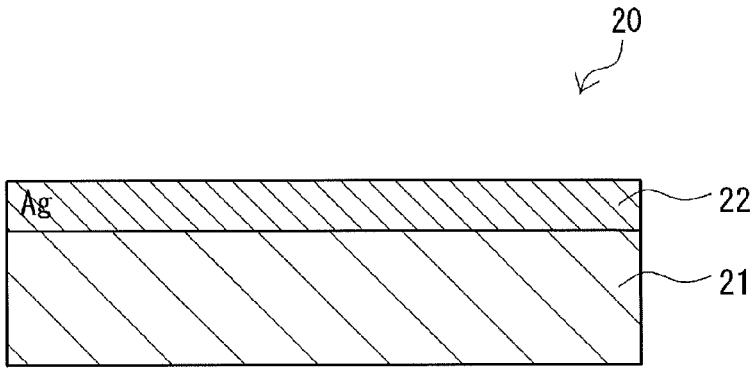
Figure 2:
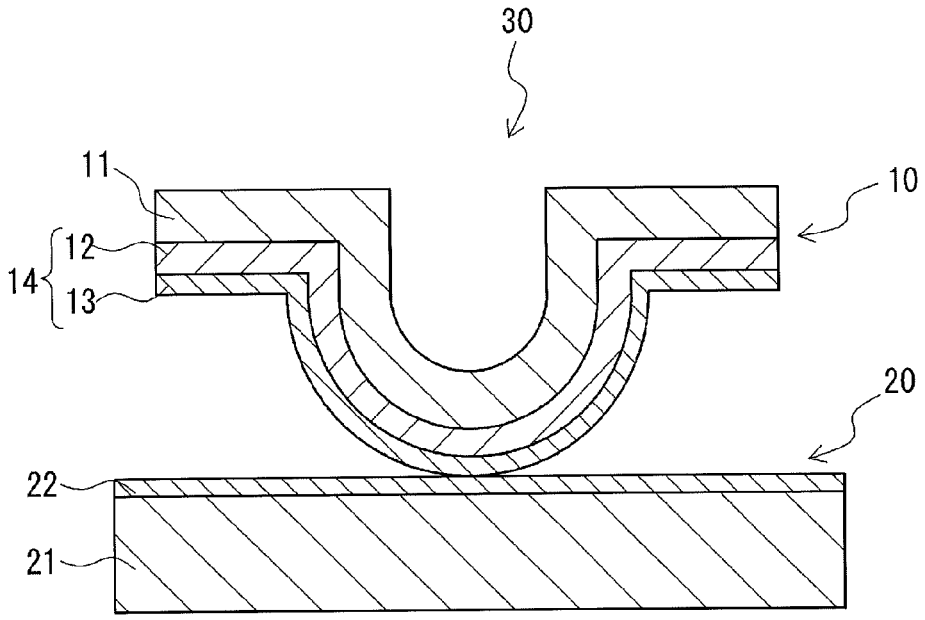
FIG. 2 is a cross-sectional view schematically showing an electric contact according to an embodiment of the present disclosure.

A configuration of an electric contact 30 according to an embodiment of the present disclosure is shown in FIGS. 1 and 2. The electric contact 30 includes an embossed contact (bulge-shaped contact) 10 and a flat plate-shaped contact (plate-shaped contact) 20, which are a pair of contacts that face each other and come into electrical contact with each other.

The embossed contact 10 bulges out so as to form an embossed shape, and the surface of the embossed contact 10 has an alloy-containing layer structure 14 including a silver-tin alloy layer 12 and a silver coating layer 13. The flat plate-shaped contact 20 has a flat plate shape, and the surface of the flat plate-shaped contact 20 has a silver single-layer structure including a silver layer 22. The embossed contact 10 and the flat plate-shaped contact 20 are in electrical contact with each other at an apex portion of the bulge shape of the embossed contact 10.

Embossed Contact

As shown in FIGS. 1A and 2, at the embossed contact 10, an alloy-containing layer structure 14 is formed on the surface of a base material 11. That is, the surface of the base material 11 is coated with the silver-tin alloy layer 12, the surface thereof is coated with the silver coating layer 13, and the silver coating layer 13 is exposed at the outermost surface. A configuration of plating members and a manufacturing method thereof described in Patent Document 1 can be applied as the alloy-containing layer structure 14. Hereinafter, the configuration and the manufacturing methods thereof will be described.

The base material 11 serves as a base plate for the embossed contact 10, and may be made of any metal material. Examples of a particularly preferable material include copper or a copper alloy that are most usually used as a terminal base material. Alternatively, it is also suitable that the base material 11 is made of aluminum or an aluminum alloy, or iron or an iron alloy.

Furthermore, a primer metal layer may be formed as appropriate on the surface of the base material 11. The primer metal layer can play various roles such as increasing adherence between the base material 11 and the silver-tin alloy layer 12, and suppressing diffusion of elements constituting the base material 11. Examples of the primer metal layer include a nickel (or a nickel alloy) layer and a pure copper layer. This is because in the case where the base material 11 is made of copper or a copper alloy, if a primer metal layer made of nickel or a nickel alloy is provided, diffusion of copper atoms from the base material 11 to the alloy-containing layer structure 14 is strongly prevented. In this case, the thickness of the primer metal layer made of nickel or a nickel alloy is desirably in a range of 0.5 to 1 μm in order to sufficiently prevent copper atom diffusion. Also, in the case where the base material 11 is made of a copper alloy, if a primer metal layer made of pure copper is formed on the surface of the base material 11, the adherence between the base material 11 and the alloy-containing layer structure 14 increases.

The silver-tin alloy layer 12 is formed on the base material 11. As described later, the silver-tin alloy layer 12 can be formed by an alloying reaction through heating a silver/tin layer structure 14' in which a silver raw material layer 14*a* and a tin raw material layer 14*s* are layered one over another. The silver-tin alloy layer 12 contains a silver-tin alloy as its main component, and more specifically, has a main phase having a $Ag_4Sn$ composition.

The silver coating layer 13 is formed on the surface of the silver-tin alloy layer 12, and the silver coating layer 13 is exposed at the outermost surface of the alloy-containing layer structure 14. It is preferable that the silver coating layer 13 is a layer containing silver as the main component and has the properties of soft silver. In general, a silver layer having a Vickers hardness of 100 or 150 is referred to as a "soft silver layer", and a silver layer having a Vickers hardness of at least 150 is referred to as "hard silver layer". Note that although the silver coating layer 13 formed on the outermost layer of the alloy-containing layer structure 14 and the silver layer 22 that forms the silver single-layer structure of the flat plate-shaped contact 20 are similar to each other in that both are metal layers containing silver as their main component, in the present specification, in order to distinguish them more clearly, the silver coating layer 13 and the silver layer 22 are respectively referred to as "silver coating layer (13)" and "silver layer (22)". Also, in order to distinguish them more clearly, a layer that coats the surface of the silver-tin alloy layer 12 and contains silver as its main component, in the complete alloy-containing layer structure 14 is referred to as "silver coating layer (13)", whereas a layer that is included in the silver/tin layer structure 14' that forms such a layer structure through heating and is made of silver is referred to as "silver raw material layer (14*a*)".

In this manner, compared to a case where the metal layer that covers the surface of the base material 11 is made of only silver, a low frictional coefficient can be obtained on the surface of the silver coating layer 13 by the silver-tin alloy layer 12 being formed on the surface of the base material 11 and the surface thereof being coated with the silver coating layer 13. It is known that the frictional coefficient decreases in the case where a soft metal layer is formed on a hard metal layer, and it is conceivable that a low frictional coefficient results if a soft silver coating layer 13 is formed on a hard silver-tin alloy layer 12.

Furthermore, compared to a case where the silver-tin alloy layer 12 is exposed at the outermost surface, in the alloy-containing layer structure 14, an increase in a contact resistance value when the alloy-containing layer structure exposed to a high temperature environment can be kept low if the silver-tin alloy layer 12 is coated with the silver coating layer 13. It seems that this is because tin oxide is not formed on the outermost surface due to the silver-tin alloy layer 12 being not exposed at the outermost surface. Thus, in addition to the fact that the silver-tin alloy and silver have high melting points and are thermally stable, keeping an increase in contact resistance at a high temperature low makes it preferable to use the alloy-containing layer structure 14 in an electric contact, like a connector terminal for a large electric current, which easily reaches a high temperature.

Here, the silver coating layer 13 is desirably formed thinner than the silver-tin alloy layer 12. This is because the effect of reducing a frictional coefficient resulting from the formation of a soft silver coating layer 13 on the hard silver-tin alloy layer 12 as described above is significant if the silver coating layer 13 is thinner than the silver-tin alloy layer 12.

Furthermore, it is preferable that the thickness of the silver-tin alloy layer 12 is in a range of 1 to 45 μm and the thickness of the silver coating layer 13 is in a range of 0.5 to 15 μm. More preferably, the thickness of the silver-tin alloy layer 12 is in a range of 1 to 9 μm and the thickness of the silver coating layer 13 is in a range of 0.5 to 3 μm. The effect of reducing the frictional coefficient is realized by the balance between the thickness of the silver-tin alloy layer 12 and the thickness of the silver coating layer 13, and if either one of them is extremely thick or thin, the frictional coefficient cannot be significantly reduced. Also, if the silver coating layer 13 is extremely thin, the effect of suppressing an increase in the contact resistance due to tin oxide being not formed on the outermost layer after exposure to a high temperature, or the effect of suppressing an increase in the contact resistance when the embossed contact 10 and the flat plate-shaped contact 20 are slid against each other as described later are unlikely to be exhibited. On the other hand, if the silver-tin alloy layer 12 is extremely thin, the effect of suppressing an increase in resistance when the alloy-containing layer exposed to a high temperature is unlikely to be exhibited.

The total thickness of the silver-tin alloy layer 12 and the silver coating layer 13 is desirably in a range of 0.4 to 60 μm. Furthermore, if the embossed contact 10 is used as a terminal for a large electric current, the total thickness thereof is desirably in a range of about 5 to 30 μm.

Next, an example of a method for manufacturing the alloy-containing layer structure 14 will be simply described. The alloy-containing layer structure 14 can be obtained by electroplating or the like by producing a silver/tin layer structure 14' in which a silver raw material layer **14*a* containing silver as the main component and a tin raw material layer 14*s* containing tin as the main component are alternately layered on one another, on the base material 11 surface on which the primer metal layer is formed as appropriate, and heating the resulting silver/tin layer structure 14'. Tin and silver easily forms a stable silver-tin alloy, and thus when the silver/tin layer structure 14' is heated, the tin raw material layer 14*s* undergoes an alloying reaction with a silver raw material layer 14*a* located below and/or on the silver raw material layer 14*s*, forms a $Ag_4Sn$ alloy, and becomes the silver-tin alloy layer 12. The silver coating layer 13 that coats the silver-tin alloy layer 12 and is exposed at the outermost surface is formed by silver that is not used in alloying, at the same time as the formation of the silver-tin alloy layer 12**.

From the viewpoint of forming the silver coating layer 13 on the outermost surface, the outermost surface is not the tin raw material layer **14*s* but the silver raw material layer 14*a* in the silver/tin layer structure 14' before heating. As long as the outermost surface is the silver raw material layer 14*a*, the number of layers of the entire silver/tin layer structure 14' can be determined as suitable. However, the greater the number of layers is, the more steps for forming the silver/tin layer structure 14' are necessary, and the cost for manufacturing the alloy-containing layer structure 14 increases. From this viewpoint, it is preferable that the number of layers that constitute the silver/tin layer structure 14'** is small.

Figure 3A:
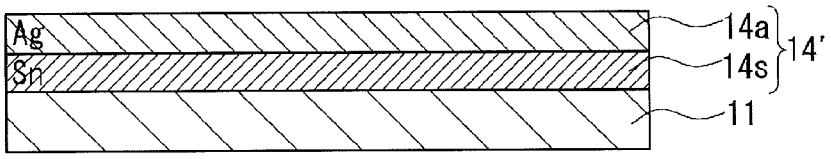
FIGS. 3A and 3B are cross-sectional views showing a silver/tin layer structure before heating in a step of manufacturing an alloy-containing layer structure, where

The lowest number of layers that constitute the silver/tin layer structure 14' is achieved with the two-layer structure shown in FIG. 3A. That is, the tin raw material layer **14*s* is formed on the surface of the base material 11 in which a primer metal layer is formed as appropriate, and the silver raw material layer 14*a* is formed on the surface thereof. In the case where the primer metal layer made of nickel or a nickel alloy is formed on the surface of the base material 11, if the undermost layer of the silver/tin layer structure 14' is the tin raw material layer 14*s* in the two-layer structure of FIG. 3A when undergoing heating, a nickel-tin alloy is likely to be formed between the primer metal layer and the alloy-containing layer structure 14**.

Figure 3B:
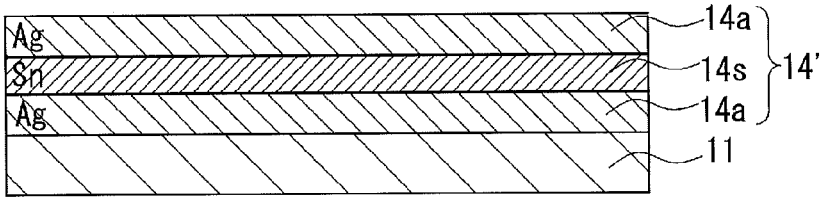

A three-layer structure as shown in FIG. 3B is the structure with the second lowest number of layers that form the silver/tin layer structure 14'. That is, the silver raw material layer **14*a*, the tin raw material layer 14*s*, and the silver raw material layer 14*a* are layered in this order on the surface of the base material 11 in which the primer metal layer is formed as appropriate. In this manner, sandwiching the tin raw material layer 14*s* from above and bottom with the silver raw material layer 14*a* makes it easy to alloy tin that constitutes the tin raw material layer 14*s*** with silver sufficiently when heated.

The silver raw material layer **14*a* that forms the silver/tin layer structure 14' is desirably made of soft silver. As described above, this is because in order to achieve a decrease in the frictional coefficient in the alloy-containing layer structure 14 manufactured through heating, the silver coating layer 13 formed on the outermost surface preferably has the properties of soft silver, and in order to achieve that, the silver raw material layer 14*a* that forms the silver/tin layer structure 14'** before heating is also desirably made of soft silver.

The silver raw material layer **14*a* other than the outermost surface of the silver/tin layer structure 14' needs to be completely reacted with the tin raw material layer 14*s* at the time of heating so as to undergo alloying. On the other hand, a portion of the silver raw material layer 14*a* at the outermost surface needs to be kept without alloying, and the silver coating layer 13 needs to be formed. Therefore, the silver raw material layer 14*a* at the outermost surface should be thicker than the silver raw material layer 14*a* that is not at the outermost surface. Preferable conditions relating to the thicknesses of the silver raw material layer 14*a* and the tin raw material layer 14*s* that constitute the silver/tin layer structure 14'** are as those described in detail in Patent Document 1.

It is preferable that a heating temperature when the alloy-containing layer structure 14 is formed by heating the silver/tin layer structure 14' made of the tin raw material layer **14*s* and the silver raw material layer 14*a*** is from 180° C. to about 300° C. It is sufficient that a heating time is set as appropriate such that the alloying reaction sufficiently advances at the selected heating temperature.

In particular, the heating temperature is preferably set to at least 180° C. and not more than the melting point of tin (232° C.). This is because the alloying reaction slowly advances at the interface at which the tin raw material layer **14*s* and the silver raw material layer 14*a* are in contact with each other at a temperature lower than the melting point of tin, and therefore there tend to be no differences in the speed of alloying depending on the in-plane location of the alloy-containing layer structure 14, so that a silver-tin alloy layer 12 having high in-plane uniformity with regard to the composition and the thickness is formed. Also, the interface between the silver-tin alloy layer 12 and the silver coating layer 13 is formed smoothly. Moreover, as the results of these, the silver coating layer 13 is also formed with an even thickness, and the outermost surface has high smoothness. If heating is performed at a temperature that is greater than or equal to the melting point of tin, tin diffuses at high speed in the silver raw material layer 14***a* and forms an alloy, and thus alloying can be completed with short heating. However, in order to form a good layer structure of the silver-tin alloy layer 12 and the silver coating layer 13, it is necessary to precisely control the parameters at the time of heating, such as the heating method and the heating time.

Flat Plate-shaped Contact

As shown in FIG. 1B, in the flat plate-shaped contact 20, a silver single-layer structure including the silver layer 22 containing silver as its main component is formed on the surface of the base material 21, and is formed so as to be exposed at the outermost surface.

The base material 21 is a base material for the flat plate-shaped contact 20, and similarly to the base material 11 of the embossed contact 10, may be constituted by any metal material. It is particularly preferable that the base material 21 is made of copper or a copper alloy. Alternatively, it is also preferable that the base material 21 is made of aluminum or an aluminum alloy, or iron or an iron alloy.

The oxidized silver layer 22 may contain not only pure silver but also other additive elements as long as it is a metal layer containing silver as the main component. For example, a small amount of selenium, antimony, or the like may be added so as to increase the hardness as long as the added amount does not increase the resistance value by oxidation. The silver layer 22 is preferably formed by electroplating.

For the purpose of increasing the adherence between the base material 21 and the silver layer 22 and suppressing the diffusion of constituent elements of the base material 21, a base material metal layer made of another type of metal may be formed as appropriate between the base material 21 and the silver layer 22. Examples of such a primer metal layer include a nickel (or a nickel alloy) layer and a pure copper layer. In addition to these primer metal layers, layers of other types of metal may also be provided between the base material 21 and the silver layer 22, but unlike the above-described alloy-containing layer structure 14 formed on the surface of the embossed contact 10, a layer made of a silver-tin alloy cannot be provided at least directly below the silver layer 22 (a position at which the layer is in contact with the silver layer 22 on the side of the base material 21).

Silver has a high melting point, is thermally very stable, and an oxide film is unlikely to form on its surface even at high temperatures. Also, silver has a high electrical conductivity. Therefore, even if a large electric current is applied to the flat plate-shaped contact 20 in which the silver layer 22 is formed as the outermost surface and the flat plate-shaped contact 20 reaches a high temperature, a low contact resistance is maintained and high connection reliability can be obtained.

The silver layer 22 is preferably thicker than the silver coating layer 13 of the embossed contact 10. Accordingly, the silver layer 22 can easily display the property of providing a contacting portion with a low contact resistance even if undergoing friction between the embossed contact 10 and the flat plate-shaped contact 20 are easily exhibited.

Note that although the case has been explained that the plate-shaped contact is the flat plate-shaped contact 20, the plate-shaped contact does not need to have a flat plate shape, and may be formed into a curved surface plate as long as the surface of the plate-shaped contact does not have a bulge structure having a curvature larger than that of the bulge shape of the bulge-shaped contact 10.

Properties of Electric Contact

As described above, this electric contact 30 includes the embossed contact 10 that has a surface having the alloy-containing layer structure 14 including silver-tin alloy layer 12 and the silver coating layer 13, and the flat plate-shaped contact 20 that has a surface having a silver single-layer structure including the silver layer 22. The silver coating layer 13 of the embossed contact 10 and the silver layer 22 of the flat plate-shaped contact 20 come into contact with each other, and conduction is formed between both contacts 10 and 20.

As described above, the silver-tin alloy layer 12, the silver coating layer 13, and the silver layer 22 have high melting points and are thermally very stable, and thus the embossed contact 10 and the flat plate-shaped contact 20 can bear to be used at high temperatures. Also, layers that contain silver as the main component, which is unlikely to be oxidized even at high temperature of the embossed contact 10 and the flat plate-shaped contact 20 are exposed at the outermost surfaces, and thus these contacts are unlikely to be oxidized even in a high temperature environment and provide low contact resistance. Because of these factors, this electric contact 30 can be preferably used in a site that easily reaches high temperatures, such as a connector terminal for a large electric current or the like.

A combination is adopted in which the alloy-containing layer structure 14 is formed on the surface of the embossed contact 10, and the silver single-layer structure is formed on the surface of the flat plate-shaped contact 20, and thereby, when the embossed contact 10 and the flat plate-shaped contact 20 are slid on one another, a low frictional coefficient can be obtained at the interface therebetween. Also, even if both contacts 10 and 20 are repeatedly slid on one another, the contact resistance is unlikely to increase and can be kept low. Thus, this electric contact 30 has superior abrasion resistance in terms of two aspects, namely keeping a low frictional coefficient and the suppression of an increase in the contact resistance when subject to friction.

Typically, this electric contact 30 preferably has a (dynamic) frictional coefficient of not more than 1.0, and more preferably has a (dynamic) frictional coefficient of not more than 0.8. Also, it is preferable that a frictional coefficient in this region, and more preferably a frictional coefficient of not more than 1.0 is maintained even after sliding between the embossed contact 10 and the flat plate-shaped contact 20. On the other hand, it is preferable that this electric contact 30 has a contact resistance of not more than 0.5 mΩ, and more preferably has a contact resistance of not more than 0.4 mΩ. Also, even after sliding, it is preferable to maintain the contact resistance in this region. It is preferable that the absolute value of a change (increase) amount of the contact resistance during sliding is suppressed to not more than 0.2 mΩ, and alternatively is suppressed to not more than 100%, which is the percentage with respect to the value before sliding, and more preferably is suppressed to not more than 50%.

Although the values of the frictional coefficient and the contact resistance depend on parameters such as the curvature of the embossed contact 10 and the load applied between both contacts 10 and 20, if the radius of curvature of the embossed contact 10 is set to 0.5 to 6 mm and the applied load is set to 2 to 20 N, for example, a frictional coefficient and a contact resistance as described above can be achieved. Also, this electric contact 30 exhibits a stable low frictional coefficient and contact resistance even after sliding, and thus when the frictional coefficient and the contact resistance after sliding are measured, as shown in the working examples below, it is sufficient to perform sliding 200 round trips over a 7 mm distance, for example. At this electric contact 30, although there are cases where the frictional coefficient changes due to a change in the surface state during multiple times of sliding in this manner, if sliding is performed 200 round trips over a 7 mm distance, an average value of frictional coefficients in all the sliding processes is preferably not more than 0.6.

Here, if the alloy-containing layer structure 14 is formed on the surfaces of both the embossed contact 10 and the flat plate-shaped contact 20, a very low frictional coefficient can be obtained in the contact interface between both contacts 10 and 20 due to the effect that a very hard silver-tin alloy layer 12 is present in the layer below the silver coating layer 13. However, if at least a portion of the silver coating layer 13 is scraped off and the silver-tin alloy layer 12 is exposed by repetitive sliding between both contacts 10 and 20, the contact resistance between both contacts 10 and 20 significantly increases. It seems that this is because the silver-tin alloy layer 12 has a resistivity higher than that of the silver coating layer 13 and the silver-tin alloy layer 12 is likely to be oxidized by contact with the air. That is, if the alloy-containing layer structures 14 are formed on the surfaces of both contacts 10 and 20, the electric contact has superior abrasion resistance in the sense of having a low frictional coefficient, but has low abrasion resistance in the sense of suppression of an increase in contact resistance when subject to friction.

On the other hand, if silver single-layer structures including the silver layers 22 are formed on the surfaces of both the embossed contact 10 and the flat plate-shaped contact 20, the silver layer 22 has a low resistivity and the surface thereof is unlikely to be oxidized, and therefore has very low contact resistance. Even if at least a portion of the silver layer 22 is scraped off by repetitive sliding, low contact resistance is maintained unless a metal layer that provides high contact resistance due to exposure is present between the silver layer 22 and the base material. For example, if a nickel primer metal layer is formed between the silver layer 22 and the base material, even if the silver layer 22 undergoes repetitive sliding, low contact resistance that is almost equal to that before undergoing repetitive sliding is maintained. However, since the silver layer 22 is soft, the surface thereof has a very large frictional coefficient. That is, if the silver single-layer structures are formed on the surfaces of both contacts 10 and 20, the electric contact has superior abrasion resistance in the sense of suppression of the contact resistance when subject to friction, but has low abrasion resistance in the sense of having a low frictional coefficient.

Compared to configurations where layer structures of the same type of metal are formed at both contacts 10 and 20, the electric contact 30 according to the embodiment of the present disclosure in which the alloy-containing layer structure 14 is formed on the surface of the embossed contact 10 and the silver single-layer structure is formed on the surface of the flat plate-shaped contact 20 has a frictional coefficient that is higher than that in the case where the alloy-containing layer structures 14 are formed at both contacts 10 and 20 and is lower than that in the case where the silver single-layers are formed at both contacts 10 and 20. At the same time, when undergoing repetitive sliding, the electric contact 30 has low contact resistance, which is close to that in the case where the silver single-layer structures are formed at both contacts 10 and 20.

On the other hand, in contrast to the electric contact 30 according to the embodiment of the present disclosure, if the silver single-layer structure is formed on the surface of the embossed contact 10 and the alloy-containing layer structure 14 is formed on the surface of the flat plate-shaped contact 20, regarding the abrasion resistance, an electric contact exhibits a behavior similar to that when the alloy-containing layer structures 14 are formed on the surfaces of both contacts 10 and 20. That is, the electric contact has a low frictional coefficient but the contact resistance significantly increases when subject to abrasion.

This indicates that the reason why the electric contact 30 according to the embodiment of the present disclosure has high abrasion resistance in terms of two aspects, namely, a low frictional coefficient and suppression of an increase in the contact resistance when subject to friction, is not only due to the formation of the alloy-containing layer structure 14 on the surface of one of the paired contacts that come into contact with each other and formation of the silver single-layer structure on the surface of the other contact, but due to the formation of the alloy-containing layer structure 14 on the surface of the contact on the side where the contact has a bulge shape and the formation of the silver single-layer structure on the surface of the contact on the side where the contact has a plate shape. When the contact having a bulge shape is slid against the contact having a plate shape, the contact continues to abut against the plate-shaped contact at the same position in the apex portion, and therefore silver exposed at the outermost layer tends to be lost. However, as described above, it is conceivable that if the alloy-containing layer structure 14 is formed at the contact having a bulge shape and the silver single-layer structure is formed at the plate-shaped contact, even if a portion of silver constituting the silver coating layer 13 of the outermost layer is lost and the silver-tin alloy layer 12 starts to be exposed, the silver layer 22 formed thick on the side of the plate-shaped contact is present, and thus if the contact having a bulge shape is in contact with the plate-shaped contact via silver, a low contact resistance is assured, which suppresses an increase in the contact resistance when subject to abrasion. If the silver single-layer structure is formed on the side of the contact having a bulge shape and the alloy-containing layer structure 14 is formed on the side of the plate-shaped contact, in particular, if the silver coating layer 13 of the alloys containing layer structure 14 is thin, it is conceivable that silver of the outermost surface on the side of the plate-shaped contact is also likely to be lost, and thus silver cannot be involved in a contacting portion and a low contact resistance is unlikely to be assured.

In the electric contact 30 according to the embodiment of the present disclosure in which the alloy-containing layer structure 14 is formed on the surface of the embossed contact 10 and the silver single-layer structure is formed on the surface of the flat plate-shaped contact 20, even if the electric contact 30 undergoes multiple times of sliding in this manner, the alloy-containing layer structure 14 or the silver single-layer structure of the surfaces are unlikely to be lost, and the primer metal layer of nickel or the like and base material metal such as copper are unlikely to be exposed. In particular, in the embossed contact 10, as shown in a working example later, there are cases where a portion of the alloy-containing layer structure 14 is subjected to abrasion and the metal of the lower layer is exposed, but it is preferable that the exposure of the base metal is suppressed to an extent that the exposure occurs in the form of stripes, and the alloy-containing layer 14 remains in the most part of the surface. In the embossed contact 10, if the primer metal layer made of nickel or a nickel alloy is formed, even if the primer metal layer is exposed in the form of stripes, it is preferable that the base material metal of the layer below the primer metal layer is not exposed at the surface. On the other hand, in the flat plate-shaped contact 20, it is preferable that the primer metal layer and the base material metal are not exposed at the surface. To determine whether or not the primer metal layer and the base material metal are exposed at both contacts 10 and 20 after undergoing sliding, for example, it is sufficient to perform sliding of 200 round trips over a 7 mm distance while a load of 5 N is applied.

Connector Terminal Pair

Figure 4:
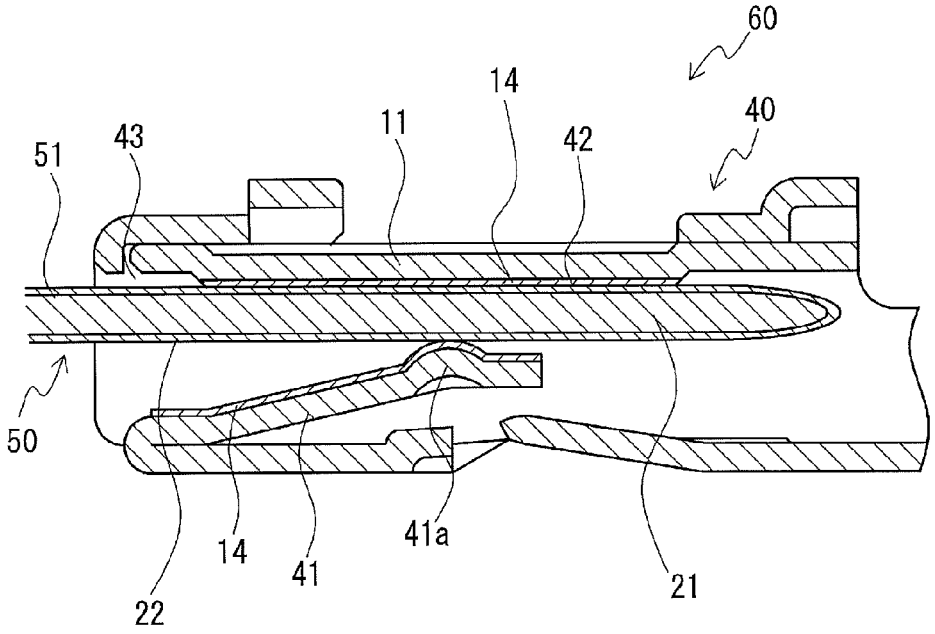
FIG. 4 is a cross-sectional view schematically showing a connector terminal pair according to an embodiment of the present disclosure.

A connector terminal pair according to an embodiment of the present disclosure may have any overall shape as long as the pair has the electric contact 30 including the embossed contact 10 having the alloy-containing layer structure 14 and the flat plate-shaped contact 20 having the silver single-layer structure. As shown in FIG. 4, as one example, a connector terminal pair 60 according to an embodiment of the present disclosure is fittable and includes a combination of a female-type connector terminal 40 and a male-type connector terminal 50. An electric contacting portion in which the female-type connector terminal 40 and the male-type connector terminal 50 come into electrical contact with each other has the above-described electrical contact 30. Specifically, the alloy-containing layer structure 14 including the silver-tin alloy layer 12 and the silver coating layer 13 is formed on the surface of a contacting portion of the female-type connector terminal 40, and the silver single-layer structure including the silver layer 22 is formed on the surface of a contacting portion of the male-type connector terminal 50.

The female-type connector terminal 40 and the male-type connector terminal 50 have shapes similar to those of a known female-type connector terminal and a known male-type connector terminal. That is, a pressing portion 43 of the female-type connector terminal 40 is formed into a square tube shape with a forward opening, and an elastic contacting piece 41 having a shape in which the contact piece is folded inwardly to the rear is formed inside the bottom surface of the pressing portion 43. On the other hand, the male-type connector terminal 50 has, on its front end, a tab 51 formed into a flat plate. When the tab 51 of the male-type connector terminal 50 is inserted into the pressing portion 43 of the female-type connector terminal 40, the elastic contacting piece 41 of the female-type connector terminal 40 comes into contact with the male-type connector terminal 50 at an embossed portion 41*a* that bulges inward into the pressing portion 43, and applies an upward force to the male-type connector terminal 50. The surface of a ceiling portion of the pressing portion 43 that faces the elastic contacting piece 41 serves as an inwardly facing contacting face 42, and the male-type connector terminal 50 is pressed and held inside the pressing portion 43 by the male-type connector terminal 50 being pressed against the inwardly facing contacting face 42 by the elastic contacting piece 41. That is, contacting portions that come into electrical contact are formed between the surface of the tab 51 of the male-type connector terminal and the embossed portion 41*a* and the inwardly facing contact surface 42 of the female-type connector terminal 40.

Here, the alloy-containing layer structure 14 including the silver-tin alloy layer 12 and the silver coating layer 13 is formed at least on the surface of the embossed portion 41*a* of the elastic contacting piece 41 of the base material 11 that forms the female-type connector terminal 40. The silver single-layer structure including the silver layer 22 is formed at least on the face disposed on the underside of the tab 51, that is, on a face that comes into contact with the embossed portion 41*a*, of the surfaces of the base material 21 that forms the male-type connector terminal 50. That is, the electric contact 30 according to the embodiment of the present disclosure is formed between the embossed portion 41*a* of the female-type connector terminal 40 and the surface of the tab 51 of the male-type connector terminal. Note that FIG. 4 shows the state in which in addition to these sites, the alloy-containing layer structure 14 is formed on the inwardly facing contacting face 42 of the female-type connector terminal 40, and the silver single-layer structure is formed on the face disposed on the upper side of the tab 51 of the male-type connector terminal 50.

Accordingly, when the male-type connector terminal 50 and the female-type connector terminal 40 are fit to each other by inserting the tab 51 of the male-type connector terminal 50 into the pressing portion 43 of the female-type connector terminal 40 and sliding the tab and the pressing portion, a low frictional coefficient is obtained in at least a contacting portion between the embossed portion 41*a* of the female-connector terminal 40 and the tab 51 of the male-type connector terminal 50 and an increase in the contact resistance is suppressed even when undergoing repetitive sliding due to insertion and removal of a terminal pair.

Note that the alloy-containing layer structure 14 and the silver layer 22 may be formed in wider regions of the connector terminals 40 and 50. In the case of the widest region, the entire surfaces of the base materials 11 and 21 that constitute both connector terminals 40 and 50 may be coated.

WORKING EXAMPLES

Hereinafter, working examples and comparative examples of the present disclosure will be described.

Production of Test Pieces

Alloy-containing Layer Structure

A nickel primer layer having a thickness of 1.5 μm was formed on the surface of a clean copper substrate by electroplating. By electroplating, a tin layer (1.3 μm in thickness) was formed as a tin raw material layer and a soft silver layer (2.2 μm in thickness) was formed as a silver raw material layer on this surface one by one in this order. These materials were heated for 1 minute at 290° C. in the atmosphere. A test piece having the alloy-containing layer structure in which a silver coating layer was formed on the surface of the silver-tin alloy layer was obtained in this manner.

By observing the cross-section of the obtained test piece with a scanning electron microscope (SEM), it was confirmed that the silver-tin alloy layer having a thickness of 2.3 μm and the silver coating layer having a thickness of 1.5 μm were stacked on each other in the form of layers, and by energy-dispersive X-ray spectroscopy (EDX) with a SEM, it was confirmed that these layers were made of a silver-tin alloy ($Ag_4Sn$) and silver, and a nickel-tin alloy ($Ni_3Sn_2$) was formed at the interface between the silver-tin alloy layer and the nickel primer layer.

Silver Single-layer Structure

A nickel primer layer having a thickness of 1 μm was formed on the surface of a clean copper substrate by electroplating. A soft silver layer having a thickness of 5 μm was formed on this surface by electroplating. This was used as a test piece having a silver single-layer structure.

Production of Electric Contact

Working Example 1

The test piece that was obtained above and in which the alloy-containing layer structure was formed was processed into an embossed shape having a radius of curvature of 3 mm, and the resulting test piece was used as an embossed contact. Also, the test piece that was obtained above and in which the silver single-layer structure was formed was used as a flat plate-shaped contact.

Comparative Example 1

A test piece in which the alloy-containing layer structure was formed was processed into an embossed shape similar to that of Working Example 1, and the resulting test piece was used as an embossed contact. Also, another test piece in which the alloy-containing layer structure was formed was used as a flat plate-shaped contact.

Comparative Example 2

A test piece in which the silver single-layer structure was formed was processed into an embossed shape similar to that of Working Example 1, and the resulting test piece was used as an embossed contact. Also, another test piece in which the silver single-layer structure was formed was used as a flat plate-shaped contact.

Comparative Example 3

A test piece in which the silver single-layer structure was formed was processed into an embossed shape similar to that of Working Example 1, and the resulting test piece was used as an embossed contact. Also, a test piece in which the alloy-containing layer structure was formed was used as a flat plate-shaped contact.

Testing Method

Evaluation of Contact Resistance and Frictional Coefficient at the Time of Sliding With regard to the electric contacts according to Working Example 1 and the Comparative Examples, the embossed contact was brought into contact with the flat plate-shaped contact in the vertical direction and was held, and the embossed contact was pulled in the horizontal direction at a speed of 10 mm/min while a load of 5 N was applied in the perpendicular direction using a piezo actuator, and the embossed contact was slid for repetitive round trips over a 7 mm distance. The contact resistance was measured by four-terminal sensing during the repetitive sliding. At that time, the open-circuit voltage was set to 20 mV and the current flow was set to 10 mA. At the same time with this, a (dynamic) frictional force acting between the contacts was measured with a load cell. A value obtained by dividing the frictional force by the load was used as the frictional coefficient. Here, testing in which sliding was repeated for 25 round trips, and testing in which sliding was repeated for 200 round trips were performed with changed test pieces. Measurement was performed at room temperature.

Observation of Abrasion Portion

With regard to the electric contacts according to Working Example 1 and the Comparative Examples, the surface states of the embossed contacts and the flat plate-shaped contacts after sliding was performed for 25 round trips or 200 round trips while the contact resistances and frictional coefficients were measured were observed with a SEM. Also, it was confirmed with SEM-EDX whether the nickel primer layer and the copper base material were exposed at the abrasion portions of the embossed contacts.

Test Results and Discussion

In Case where Number of Instances of Sliding is 25

Figure 5A:
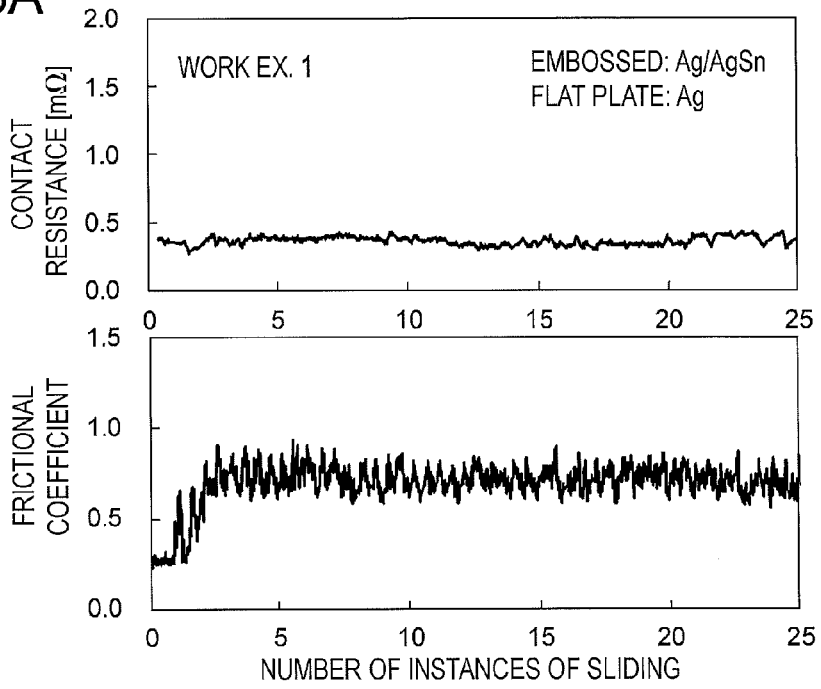
FIGS. 5A and 5B show results of measurement of contact resistance (top) and frictional coefficients (bottom) in the case where repetitive sliding was performed 25 times with regard to (FIG. 5A) Working Example 1 (embossed contact: alloy-containing layer structure, and flat plate-shaped contact: silver single-layer structure) and (FIG. 5B) Comparative Example 1 (embossed contact and flat plate-shaped contact: alloy-containing layer structure).
Figure 5B:
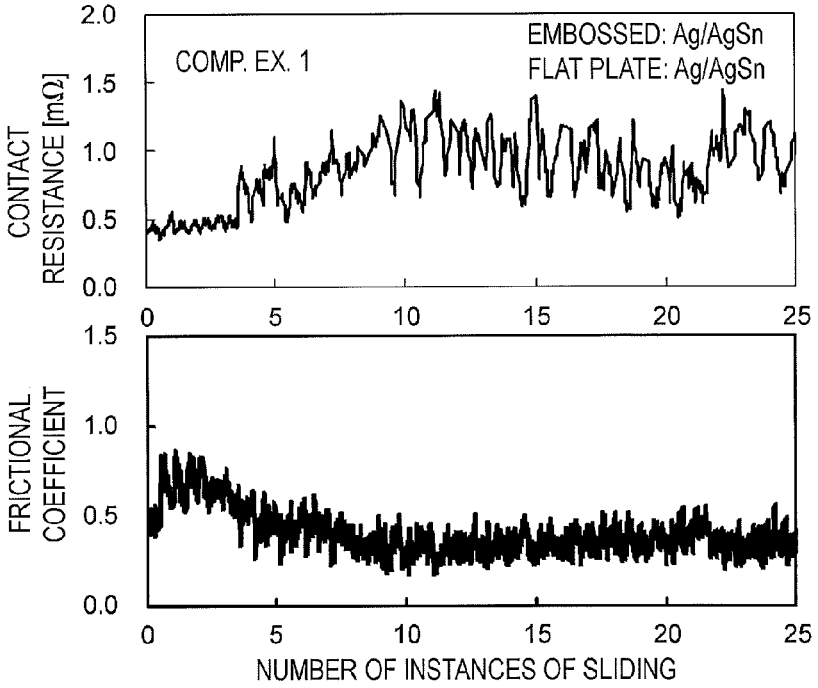
Figure 6A:
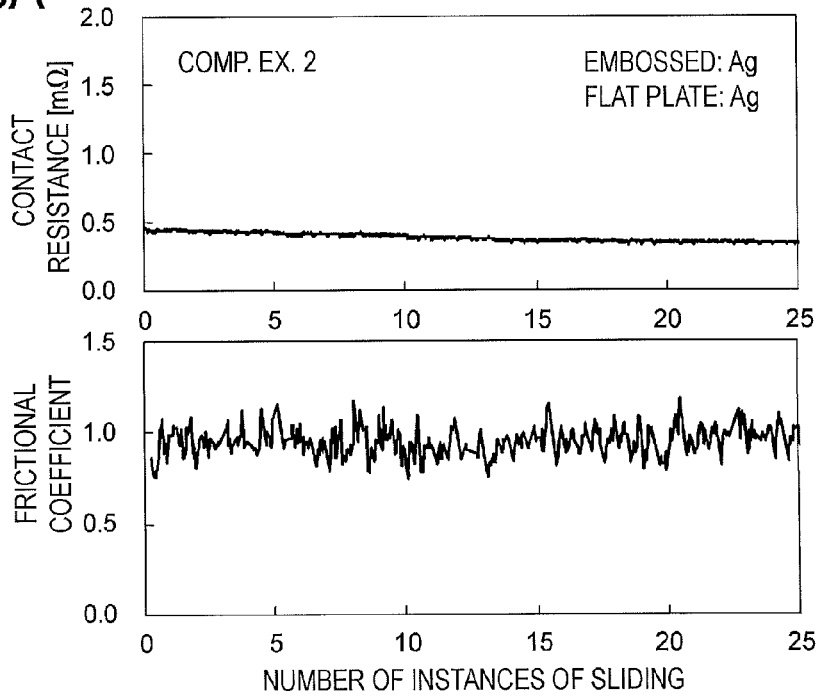
FIGS. 6A and 6B show results of measurement of contact resistance (top) and frictional coefficients (bottom) in the case where repetitive sliding was performed 25 times with regard to (FIG. 6A) Comparative Example 2 (embossed contact and flat plate-shaped contact: silver single-layer structure) and (FIG. 6B) Comparative Example 3 (embossed contact: silver single-layer structure, flat plate-shaped contact: metal-containing layer structure).
Figure 6B:
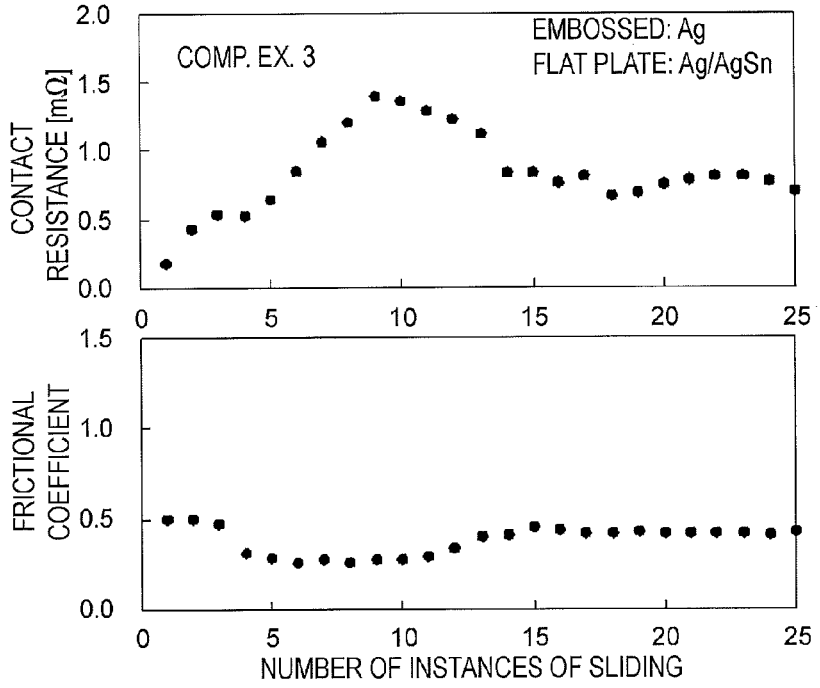

FIGS. 5 and 6 show the results of measurement of the contact resistances and frictional coefficients during sliding when sliding was performed 25 times on the electric contacts according to Working Example 1 and Comparative Examples. Note that in the measurement results of Comparative Example 3 shown in FIG. 6B, in order to eliminate the influence of noise at the time of measurement, the measurement values are as the average value for each sliding. Also, Table 1 collectively shows the values of the contact resistance and the frictional coefficient obtained in the measurement (all values are values in the latter stage of the sliding), and the lengths of the abrasion portions obtained from SEM observation images. Note that in the table, "width" in the abrasion portion of the flat plate-shaped contact refers to the width of the abrasion portion in the direction orthogonal to the sliding direction.

TABLE 1

| | | Work. Ex. 1 | Comp. Ex. 1 | Comp. Ex. 2 | Comp. Ex. 3 |
|---|---|---|---|---|---|
| Embossed contact | | Ag/AgSn | Ag/AgSn | Ag | Ag |
| Flat plate-shaped contact | | Ag | Ag/AgSn | Ag | Ag/AgSn |
| Contact resistance [mΩ] | | 0.4 | 0.7~1.1 | 0.3 | 0.7~0.9 |
| Frictional coefficient | | 0.7 | 0.2~0.4 | 0.9~1.0 | 0.4 |
| State of abrasion | Exposure of Ni primer layer at embossed contact | no exposure | no exposure | exposure (central portion) | no exposure |
| | State of embossed contact | protruding shape having height of 13 to 16 μm | protruding shape having height of 5 to 6 μm | recessed shape having depth of at least 5 μm | protruding shape having height of 40 μm and peripheral recessed shape |
| | State of flat plate-shaped contact | recessed shape having width of 350 μm and max. depth of 5 μm | recessed shape having width of 250 μm and max. depth of 3 μm | recessed shape having width of 450 μm and max. depth of 5 to 6 μm | recessed shape having width of 200 μm and max. depth of 3 μm |

After sliding, the electric contact according to Working Example 1 in which the alloy-containing layer structure was formed at the embossed contact and the silver single-layer structure was formed at the flat plate-shaped contact has a frictional coefficient higher than in the case of Comparative Example 1 in which the alloy-containing layer structures were formed at both contacts and Comparative Example 3 in which the alloy-containing layer structure was formed at the flat plate-shaped contact, whereas it has a frictional coefficient lower than in the case of Comparative Example 2 in which the silver single-layer structures were formed at both contacts. Also, after sliding, the electric contact according to Working Example 1 has very low contact resistance compared to the case of Comparative Examples 1 and 3, the contact resistance being close to the value in the case of Comparative Example 2. If this type of electric contact is applied to a terminal for a large electric current, although it is desirable that the electric contact has a frictional coefficient of not more than 0.8 and a contact resistance of not more than 0.5 mΩ even after undergoing sliding, the electric contact according to Working Example 1 has a low frictional coefficient and low contact resistance that meet either demand. Also, as shown at the top of FIG. 5A, the tendency of an increase in the contact resistance was not observed during repetitive sliding, and a stable low contact resistance is shown.

In the electric contacts according to Working Example 1 and Comparative Example 3, the alloy-containing layer structure was formed at one of the paired contacts, and the silver single-layer structure was formed at the other. However, as described above, a low frictional coefficient and the suppression of an increase in the contact resistance at the time of sliding were achieved in the case of Working Example 1, whereas Comparative Example 3 exhibits a behavior close to the case where the alloy-containing layer structures are formed at both contacts with regard to the frictional coefficient and the contact resistance. That is, the frictional coefficient is very low but the contact resistance value after sliding was high, and as shown at the top of FIG. 6B, the contact resistance value increases through multiple instances of sliding. This indicates that the arrangement of the alloy-containing layer structure on the side of the embossed contact and the arrangement of the silver single-layer structure on the side of the flat plate-shaped contact are needed to achieve both a low frictional coefficient and the suppression of an increase in the contact resistance due to friction.

In the observation of the abrasion states after sliding summarized in Table 1, a recessed shape corresponds to a portion from which a metal layer is scraped off, and a protruding shape corresponds to a portion to which a metal layer adhered that was scraped off from the contact itself or the partner side contact. Here, in association with the frictional coefficient, a state in which the silver layers of the surfaces of the contacts are scraped off will be compared. First, focusing on whether or not the recessed shape is formed at the contact having the silver single-layer structure, in Working Example 1, regardless of the formation of the soft silver single-layer structure that is likely to be scraped off at the flat plate-shaped contact, the size of the recessed shape is smaller than that of the flat plate-shaped contact of Comparative Example 2 in which the silver single-layer structure is similarly formed. Also, similarly to the case of the embossed contact of Comparative Example 1 in which the alloy-containing layer structure is formed, the alloy-containing layer structure that is unlikely to undergo abrasion is formed at the embossed contact of Working Example 1, and thereby the recessed shape is not observed after sliding. It is understood that at the electrical contact of Working Example 1, because the exposed silver is scraped off in a small amount at both the embossed contact and the flat plate-shaped contact in this manner, a relatively low frictional coefficient is obtained.

Next, in association with the presence or absence of an increase in the contact resistance due to friction, it shall be examined whether or not the recessed shape is formed at a contact having the alloy-containing layer structure. A recessed shape is not formed at the embossed contact in Working Example 1, whereas recessed shapes are formed at the flat plate-shaped contacts in Comparative Examples 1 and 3. According to this, it is understood that as a result of the silver coating layer exposed at the outermost surface of the alloy-containing layer structure being scraped off, the silver-tin alloy layer is exposed and the contact resistance increases in Comparative Examples 1 and 3, whereas in Working Example 1, the silver-tin alloy layer is not exposed at the outermost layer and an increase in the contact resistance due to the exposure of the silver-tin alloy layer does not occur.

It seems that since in the electric contact of Working Example 1, a combination is adopted in which the alloy-containing layer structure is formed at the embossed contact, and the silver single-layer structure is formed at the flat plate-shaped contact, an increase in the frictional coefficient resulting from silver exposed at the outermost surfaces of the silver single-layer structure and the alloy-containing layer structure being scraped off is suppressed, and an increase in the contact resistance due to the exposure of the silver-tin alloy layer when subject to friction is suppressed.

In Case where Number of Instances of Sliding is 200

Figure 7A:
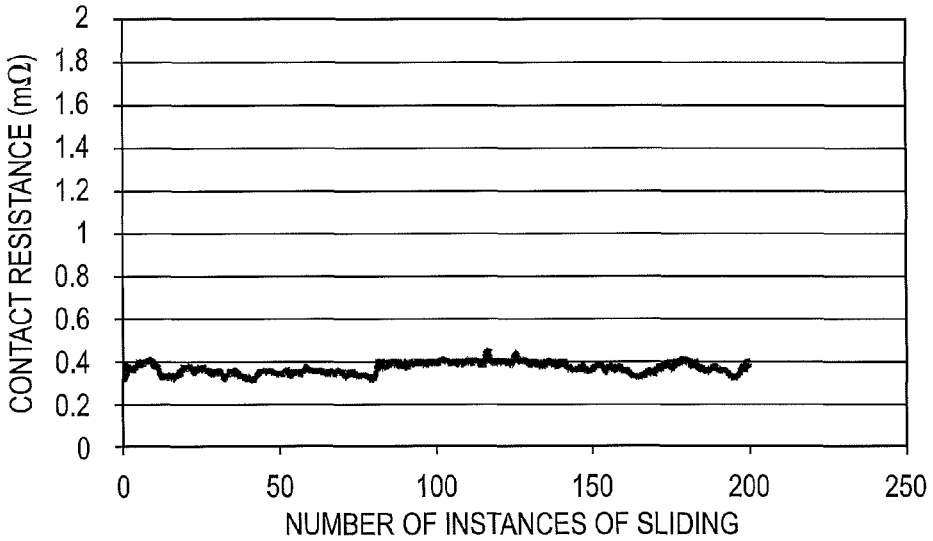
FIGS. 7A and 7B show results of measurement of contact resistance (top) and frictional coefficients (bottom) in the case where repetitive sliding was performed 200 times with regard to (FIG. 7A) Working Example 1 and (FIG. 7B) Comparative Example 1.
Figure 7A:
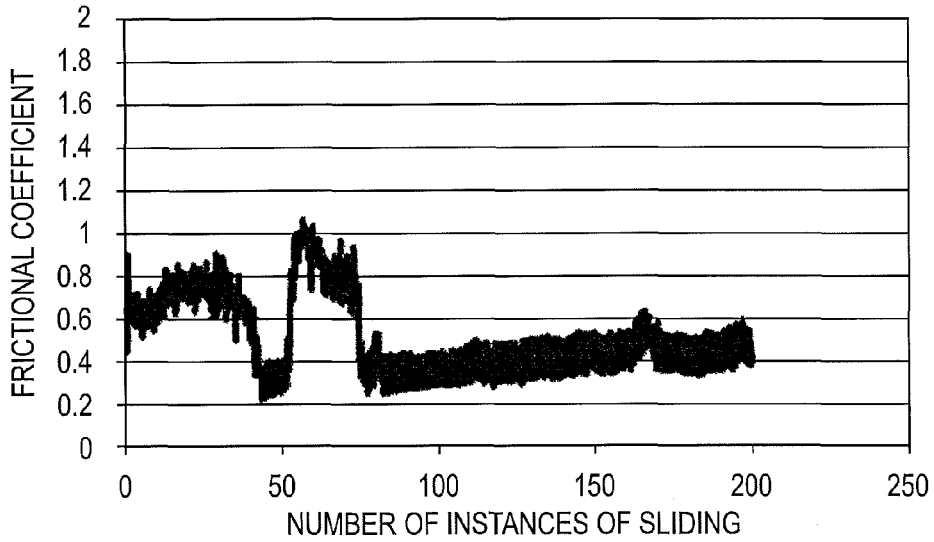
Figure 7B:
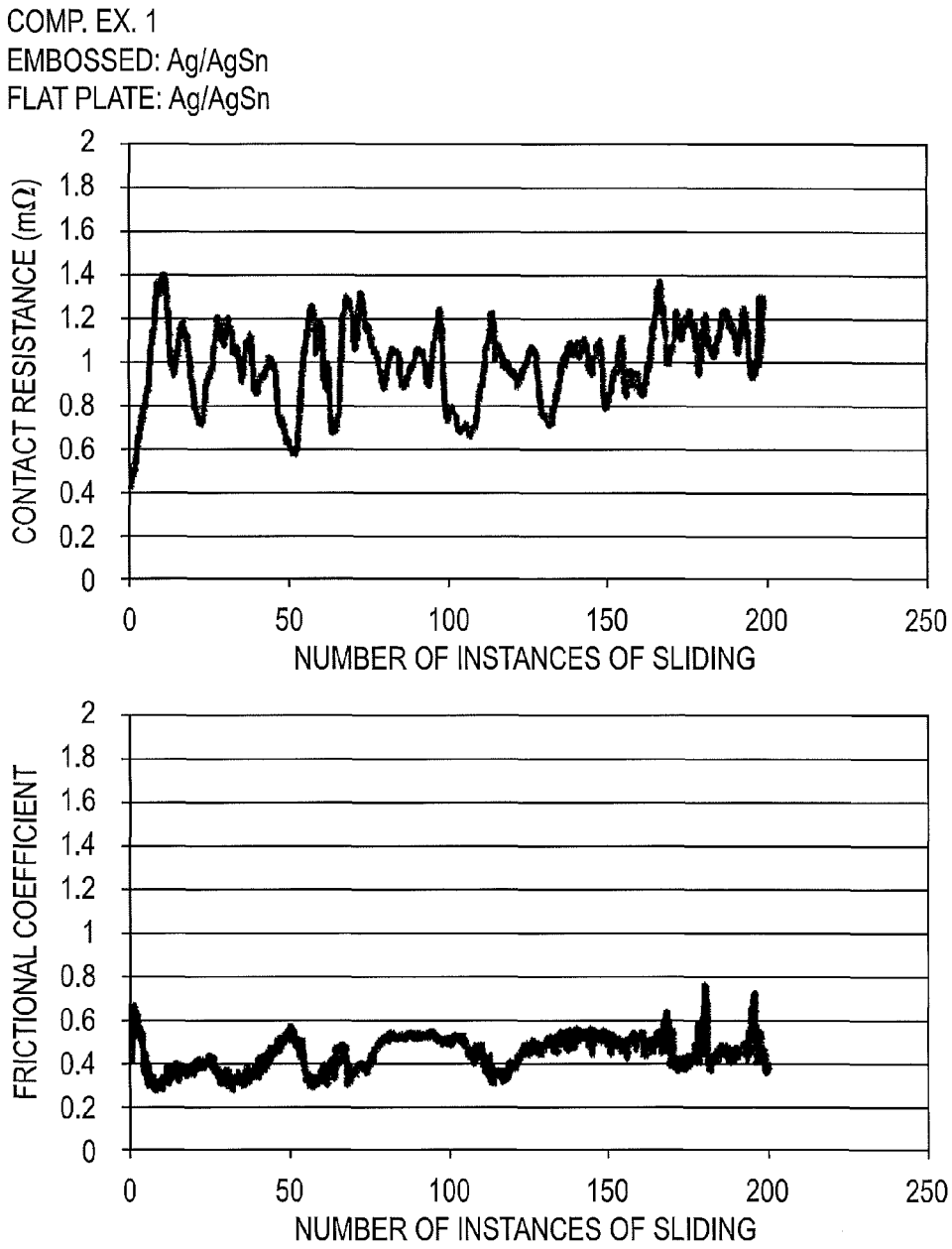
Figure 8A:
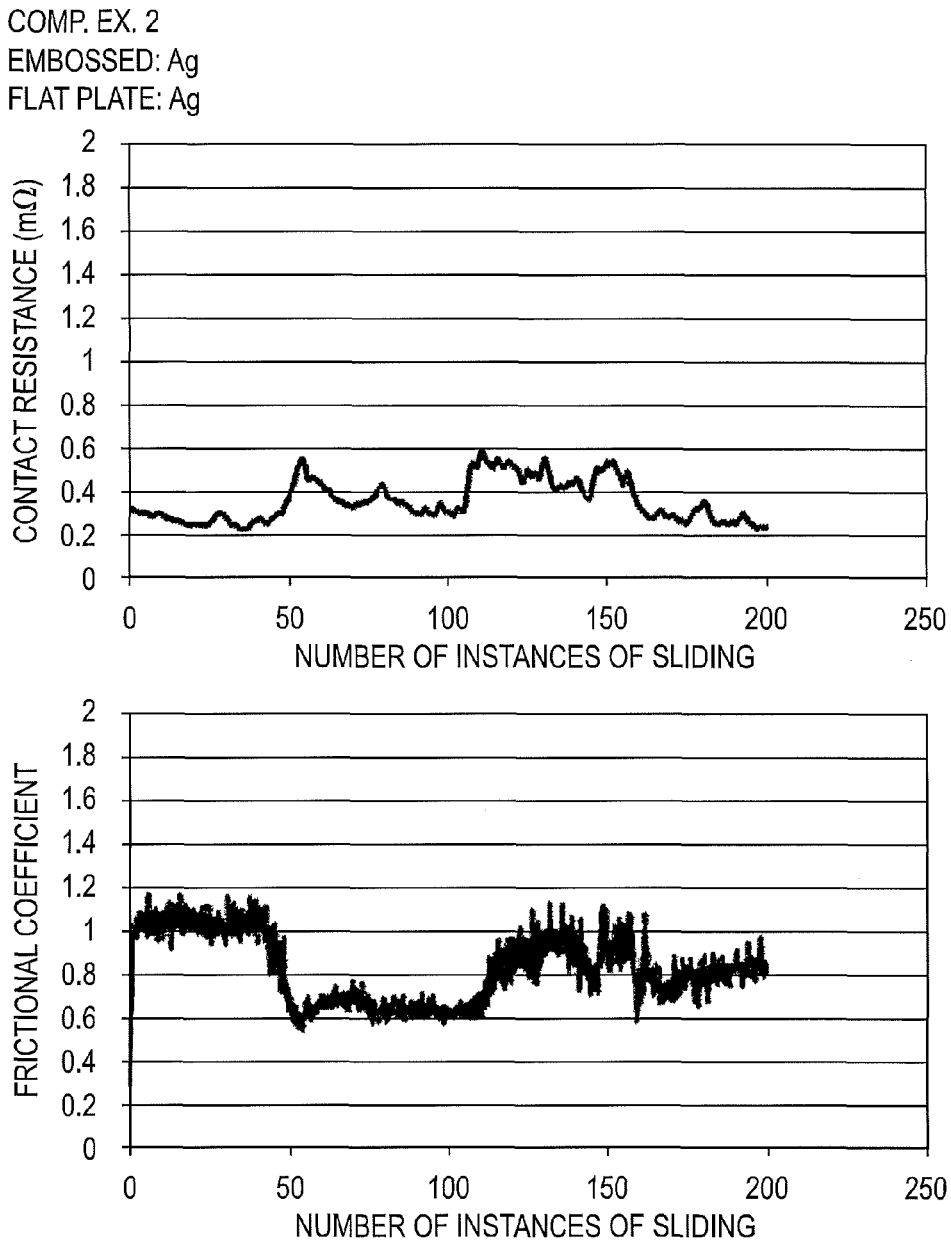
FIGS. 8A and 8B show results of measurement of contact resistance (top) and frictional coefficients (bottom) in the case where repetitive sliding was performed 200 times with regard to (FIG. 8A) Comparative Example 2 and (FIG. 8B) Comparative Example 3.
Figure 8B:
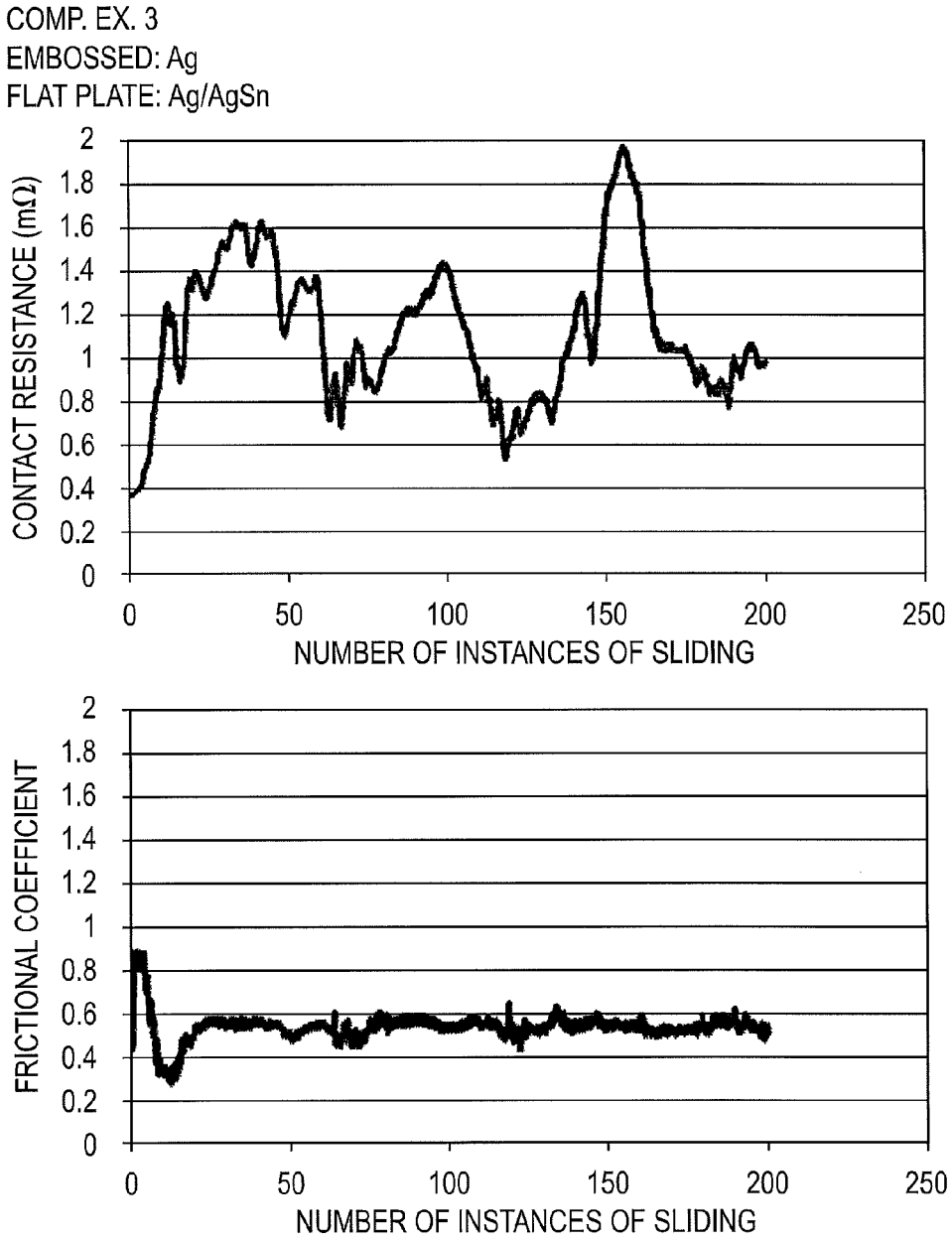

FIGS. 7 and 8 show the results of measurement of the contact resistance and frictional coefficient during sliding when sliding was performed 200 times on the electric contacts according to Working Example 1 and Comparative Examples. Also, Table 2 show the values of the contact resistance and frictional coefficient measured in FIGS. 7 and 8 (all ranges of the measurement values and average values during sliding), and shows whether or not the nickel primer layer and the copper base material are exposed at the contacts after sliding. By performing sliding 200 times, differences in the states of the electric contacts resulting from the influence of the abrasion of the surface are more significant than in the case where sliding was performed 25 times, which is described above. Note that although in the results of measurement of the contact resistance and frictional coefficient shown in FIGS. 7 and 8, the measurement values up to the 25th sliding do not completely match the measurement result in the case where sliding is performed only 25 times in FIGS. 5 and 6 above, it seems that this is caused by variations in the sample production and measurement.

TABLE 2

| | | | Work. Ex. 1 | Comp. Ex. 1 | Comp. Ex. 2 | Comp. Ex. 3 |
|---|---|---|---|---|---|---|
| Embossed contact | | | Ag/AgSn | Ag/AgSn | Ag | Ag |
| Flat plate-shaped contact | | | Ag | Ag/AgSn | Ag | Ag/AgSn |
| Value during sliding | Contact resistance [mΩ] | All ranges | 0.3~0.4 | 0.6~1.4 | 0.2~0.6 | 0.4~2.0 |
| | | Average | 0.36 | 1.00 | 0.37 | 1.12 |
| | Frictional coefficient | All ranges | 0.2~1.0 | 0.3~0.8 | 0.6~1.1 | 0.3~0.9 |
| | | Average | 0.52 | 0.45 | 0.82 | 0.54 |

TABLE 2-continued

| | | | Work. Ex. 1 | Comp. Ex. 1 | Comp. Ex. 2 | Comp. Ex. 3 |
|---|---|---|---|---|---|---|
| Exposure after sliding | Embossed contact | Ni | exposure (stripes) | exposure (bands) | exposure (bands) | exposure (bands) |
| | | Cu | no exposure | exposure | exposure | exposure |
| | Flat plate-shaped contact | Ni | no exposure | exposure | exposure | exposure |
| | | Cu | no exposure | exposure | exposure | exposure |

In the electric contacts according to Comparative Examples 1 to 3, the surface metal layers are subjected to abrasion at both the embossed contact and the flat plate-shaped contact, and not only the nickel primer layers but also copper of the base material are exposed. In contrast, with regard to the electric contact according to Working Example 1, the state in which the nickel layer and the copper base material are not exposed at the flat plate-shaped contact is maintained. Also, at least copper base material is not exposed at the embossed contact as well. Although the nickel primer layer is exposed, the exposure occurs only in the form of a plurality of thin stripes and a majority of the surface is maintained in a state in which the nickel primer layer is not exposed, which is different from the case where the nickel primer layer is exposed in the form of wide bands in the embossed contacts of Comparative Examples 1 to 3. In the electric contact according to Working Example 1 in which the alloy-containing layer structure is formed at the embossed contact and the silver single-layer structure is formed in the flat plate-shaped contact, the exposure of metal of the lower layer is suppressed at both contacts even after multiple times of sliding.

Corresponding to this, in the electric contact according to Working Example 1, a large increase in the contact resistance and the frictional coefficient from the state before sliding is suppressed during 200 times of sliding, and a state is maintained in which the electric contact has superior abrasion resistance with low contact resistance and a low frictional coefficient. Note that looking at the results of measurements of the frictional coefficient of the electric contact according to Working Example 1 shown at the bottom of FIG. 7A, in a region in which the number of instances of sliding is about 40 to 80, a behavior is found in which the frictional coefficient decreases significantly once, returns to a value approximately equal to the beginning, and decreases significantly again. It seems that this is a reproducible phenomenon, and is associated with the exposure of the nickel primer layer in the form of stripes at the embossed contact. That is, it is understood that the frictional coefficient decreases at the embossed contact when the nickel primer layer is exposed initially in the form of stripes, the frictional coefficient then increases to a value approximately equal to the beginning due to silver transferring from the surface of the flat plate-shaped contact to the embossed contact, and when the nickel primer layer is exposed at the embossed contact in the form of stripes, the frictional coefficient again decreases. Thereafter, although the frictional coefficient increases slightly, the frictional coefficient is kept at a low value. It is conceivable that this is because the nickel primer layer is partially exposed in the form of stripes at the embossed contact, and a state is stably formed in which a region of the majority of the embossed contact and a region of a portion thereof come into contact with the plate-shaped contact respectively by the silver coating layer and by the nickel primer layer. Note that it seems that compared to the behavior of the contact resistance at the top of FIG. 7A, the contact resistance slightly decreases at the position at which the frictional coefficient increases, and the contact resistance slightly increases at the position at which the frictional coefficient decreases, and thus the contact resistance also changes in correspondence with the exposure of the nickel primer layer.

In the electric contact according to Working Example 1, as described above, after the number of instances of sliding is about 80, even if sliding is repeated, low frictional coefficients and low contact resistance are stably obtained. In contrast, in the electric contact according to Comparative Examples 1 to 3, significant changes in the frictional coefficient and the contact resistance are found in the entire region for 200 times of sliding. Roughly speaking, an increase in the contact resistance and a decrease in the frictional coefficient, and a decrease in the contact resistance and an increase in the frictional coefficient occur correspondingly, and significant changes in these values are caused not by variations in measurement conditions or the like but by the surface states of both contacts. In this manner, in the electric contact according to Working Example 1, due to the effect of combination of the surface metal layers in which the alloy-containing layer structure is formed at the embossed contact, and the silver single-layer structure is formed at the flat plate-shaped contact, compared to the case of having another combination as in Comparative Examples 1 to 3, the exposure of metal of the lower layer is suppressed and a surface state in which a low frictional coefficient and a low contact resistance are stably provided is maintained even after multiple times of sliding.

Although the embodiment of the present disclosure has been described in detail above, the invention is not merely limited to the above-described embodiment, and it will be appreciated that various modifications can be made without departing from the gist of the present disclosure. For example, the bulge-shaped contact is not limited to a contact having an embossed shape in which a middle portion of a plate member as described above is bulged in the thickness direction, and a terminal pair is not limited to a fittable type as described above. An example of the bulge-shaped contact according to another embodiment includes a press-fit terminal. A press-fit terminal has a shape in which a middle portion of a plate member is bulged outward along the plate surface. A through hole into which the press-fit terminal is inserted can be considered as a plate-shaped contact having a curved surface shape. In the terminal pair including the press-fit terminal and the through hole, the alloy-containing layer structure 14 including the silver-tin alloy layer 12 and the silver coating layer 13 is formed on the surface of the press-fit terminal, and the silver single-layer needs only to be formed on an inner wall face of the through hole through which the press-fit terminal is inserted. Furthermore, the above description is merely illustrative of the inventive concept and is not intended to limit the scope thereof.

The invention claimed is:

1. An electric contact comprising:

a bulge-shaped contact having a bulge shape; and a plate-shaped contact that has a plate shape and comes into electrical contact with an apex portion of the bulge-shaped contact, wherein the bulge-shaped contact has a silver-tin alloy layer and a silver coating layer that coats a surface of the silver-tin alloy layer and is exposed at an outermost surface, the plate-shaped contact has a silver layer that does not have a silver-tin alloy layer directly below and is exposed at the outermost surface, and the silver layer formed at the plate-shaped contact is thicker than the silver coating layer formed at the bulge-shaped contact.

2. The electric contact according to claim 1, wherein the silver coating layer formed at the bulge-shaped contact is thinner than the silver-tin alloy layer.

3. The electric contact according to claim 1, wherein at the bulge-shaped contact, a primer metal layer that coats a surface of a base material and contains nickel or copper as a main component is formed, and the silver-tin alloy layer is formed in contact with the primer metal layer.

4. The electric contact according to claim 3, wherein the primer metal layer is made of nickel or a nickel alloy, and a portion of the nickel forms an alloy with tin included in the silver-tin alloy layer.

5. The electric contact according to claim 1, wherein at the bulge-shaped contact, a thickness of the silver-tin alloy layer is in a range of 1 to 45 μm and a thickness of the silver coating layer is in a range of 0.5 to 15 μm.

6. The electric contact according to claim 1, wherein a contact resistance between the bulge-shaped contact and the plate-shaped contact is not more than 0.4 mΩ, the contact resistance being measured after the bulge-shaped contact and the plate-shaped contact have been slid relative to each other.

7. The electric contact according to claim 1, wherein a change in a contact resistance between the bulge-shaped contact and the plate-shaped contact is not more than 0.2 mΩ when the bulge-shaped contact and the plate-shaped contact are slid relative to each other.

8. The electric contact according to claim 1, wherein an average value of frictional coefficients between the bulge-shaped contact and the plate-shaped contact is not more than 0.6, the frictional coefficients being measured while the bulge-shaped contact and the plate-shaped contact are slid relative to each other for 200 round trips over a 7 mm distance.

9. The electric contact according to claim 1, wherein at the bulge-shaped contact, a primer metal layer that coats the surface of the base material and is made of nickel or a nickel alloy is formed, and the silver-tin alloy layer is formed in contact with the primer metal layer, and the base material of the bulge-shaped contact is not exposed after the bulge-shaped contact and the plate-shaped contact have been slid relative to each other.

10. The electric contact according to claim 1, wherein after the bulge-shaped contact and the plate-shaped contact have been slid relative to each other, metal of a layer below the silver layer is not exposed at the plate-shaped contact.

11. A connector terminal pair, comprising:

a pair of connector terminals that come into electrical contact with each other at a contacting portion, wherein the contacting portion has the electric contact according to claim 1.

* * * * *